United States Patent [19]

Laskowski

[11] Patent Number: 4,509,431

[45] Date of Patent: Apr. 9, 1985

[54] BRIDGE CRANE HOIST STOP SYSTEM

[75] Inventor: Gordon J. Laskowski, Port Orchard, Wash.

[73] Assignee: The United States of America as represented by the Secretary of the Navy, Washington, D.C.

[21] Appl. No.: 510,702

[22] Filed: Jul. 5, 1983

[51] Int. Cl.[3] ..... B61K 7/20

[52] U.S. Cl. ..... 104/250; 104/98

[58] Field of Search ..... 104/47, 48, 96, 98–102, 104/130, 249, 250, 252

[56] References Cited

U.S. PATENT DOCUMENTS

| | | | |
|---|---|---|---|
| 1,592,815 | 7/1926 | Harris | 104/98 |
| 2,276,272 | 3/1982 | Harris | 104/98 |
| 2,471,513 | 5/1949 | Bogle | 104/98 |
| 2,642,814 | 6/1953 | Anjeskey | 104/98 |
| 2,851,960 | 9/1958 | Paine | 104/98 |
| 2,922,382 | 1/1960 | Pilipczuk | 104/98 |
| 2,947,261 | 8/1960 | Anjeskey | 104/98 |
| 3,132,598 | 5/1964 | Pearson | 104/98 |

*Primary Examiner*—Randolph Reese

*Attorney, Agent, or Firm*—R. F. Beers; C. D. B. Curry; W. C. Daubenspeck

[57] ABSTRACT

Rail interlocking and hoist stop apparatus for material handling systems of the type wherein a hoist travels between a movable rail and a stationary rail comprising a master stop assembly located on the movable rail and a slave stop assembly located on the stationary rail. The apparatus is manually actuated through a mechanical linkage which pushes a master pin in the master stop assembly toward the slave stop assembly. If the rails are in proper alignment, the end of the master pin is inserted into a bore in the slave assembly where it displaces a slave pin. The movement of the slave pin causes a crossover pin in the slave assembly to be partially inserted into a bore in the master assembly where it displaces a locking pin. The movement of the slave pin and the crossover pin in the slave assembly is rigidly coupled to stop pins located in the slave assembly and which are disposed in the path of the hoist when the stop system is unactuated. Likewise the movement of the locking pin in the master assembly is rigidly coupled to stop pins located in the master assembly. The movement of the various pins to the actuated position causes the stop pins of both assemblies to retract from the path of the hoist. The mechanical linkage to the master pin disconnects traversing power from the crane before the master pin is moved during actuation. Additionally, the master assembly and the slave assembly cannot accidentally be disengaged from each other if the hoist has not completely transferred from one rail to the other.

5 Claims, 8 Drawing Figures

BRIDGE CRANE HOIST STOP SYSTEM

BACKGROUND OF THE INVENTION

The present invention relates in general to overhead (bridge) crane systems and in particular, to a mechanism for interlocking an end of a movable track with an aligned end of a stationary track. The invention is especially directed toward a completely mechanical interlocking mechanism suitable for use in shipboard environments where it may be subjected to strong vibration and high intensity shock.

In material handling apparatus, overhead cranes are frequently provided with a carrier rail extending transversely to the direction of movement of the crane. This rail is commonly employed to support a movable hoist which may carry a load suspended therefrom. As the crane moves along its path of travel, the carrier rail comes into alignment with one or more stationary tracks which lead to other parts of the work area or other crane tracks.

Various devices have been proposed for locking a movable carrier rail to a stationary rail when the two are in aligned position. One type of mechanical hoist stop system, referred to as "paddle stops", operates automatically at each crossover position to raise the stops and permit passage of the hoist. This mechanism has the disadvantage that it does not prevent traversing a crane away from the crossover when a hoist is transfering on or off a crane. It also experiences a high wear rate as the stops are automatically cycled every time rails pass or stops align, whether or not hoist transfer is desired. In a second type of mechanical stop system, the "Richard Wilcox" type, stops are manually operated to extend a probe that automatically raises the stops when the crane is properly aligned at the crossover. This mechanism also permits traversing a crane away from the crossover during hoist transfer if the probe is manually released. Furthermore, most previous devices are not suitable for shipboard environments and in particular are not suitable for combat conditions.

SUMMARY OF THE INVENTION

It is an object of the present invention to provide hoist stop apparatus which prevents a hoist from traversing off the end of a carrier rail of a bridge crane or a stationary rail when the rails are not aligned to accept hoist transfer from one rail to another.

Another object of the present invention is to provide hoist stop apparatus to prevent the bridge crane from traversing away from the stationary rail when the hoist is transferring from one rail to the other.

Another object of the present invention is to provide such apparatus which is suitable for use under combat conditions.

A further object is to provide hoist stop apparatus having completely mechanical operation to avoid interaction with pneumatic, hydraulic or electrical components.

The hoist stop system consists of a master stop assembly located on the movable carrier rail attached to the bridge crane and a slave stop assembly located on the stationary or crossover rail. The hoist stop system is actuated by manually (through a mechanical linkage) pushing a master pin in the master stop assembly toward the slave stop assembly. If the master assembly and the slave assembly are in proper alignment (i.e. the rails are in proper alignment), the end of the master pin is inserted into a bore in the slave assembly where it displaces a slave pin. The movement of the slave pin is coupled by gearing to a crossover pin disposed in the slave assembly. The movement of the slave pin causes the crossover pin to be partially inserted into a bore in the master assembly where it displaces a locking pin. The master assembly and the slave assembly are thus joined by the master pin and the crossover pin. The movement of the slave pin and the crossover pin in the slave assembly is rigidly coupled by gearing to stop pins located in the slave assembly and which are disposed in the path of the hoist when the stop system is unactuated. Likewise the movement of the locking pin in the master assembly is rigidly coupled by gearing to stop pins located in the master assembly. The movement of the various pins to the actuated position causes the stop pins of both assemblies to retract from the path of the hoist. The mechanical linkage to the master pin disconnects traversing power from the crane before the master pin is moved during actuation. Additionally, the master assembly and the slave assembly cannot accidentally be disengaged from each other if the hoist has not completely transfered from one rail to the other.

Other advantages and features of the present invention will become apparent from the following description of the preferred embodiment when considered in conjunction with the accompanying drawings wherein:

DESCRIPTION OF THE PREFERRED EMBODIMENT

Figure 1:
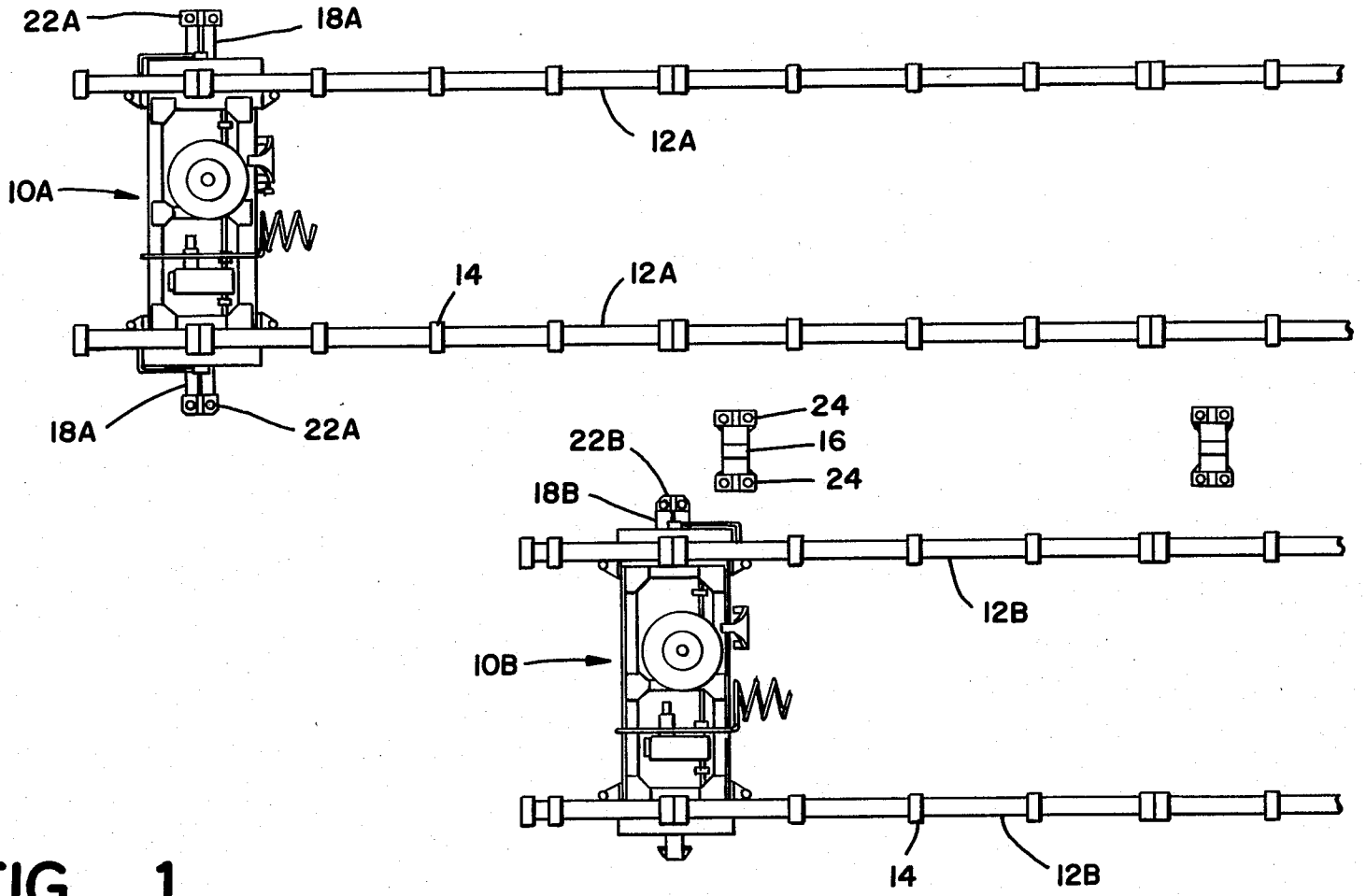
FIG. 1 is a plan view of part of a bridge crane material handling system illustrating the operational setting of the hoist stop system.

Referring now to the drawings wherein like reference characters represent like or corresponding parts in the several views, FIG. 1 illustrates a material handling system employing a hoist stop system according to the present invention. A first bridge crane 10A is shown mounted on crane support rails 12A secured to the overhead by mounting plates 14. A second bridge crane 10B is shown mounted on crane support rails 12B secured to the overhead by mounting plates 14. A crossover rail 16 is secured to the overhead by mounting plates 14 and extends between the runs of the first and second bridge cranes.

A carrier rail 17 (not visible in FIG. 1 but see FIG. 7) running transverse to the direction of travel of crane 10A is secured to the underside of plates 18A which are mounted on the bottom of bridge crane 10A. A carrier rail 17 is similarly mounted on the underside of plates 18B on the bottom of crane 10B. A master stop assembly 22A is mounted on the top of the plates 18A at each end of the first carrier rail 17. Similarly a master stop assembly 22B is mounted on the top of plates 18B at the upper end (as shown in FIG. 1) of the second carrier rail. A fixed stop 23 is provided at the lower end which is not required to interlock with any crossover rails. A slave stop assembly 24 is mounted at each end of the crossover rail 16

Figure 2:
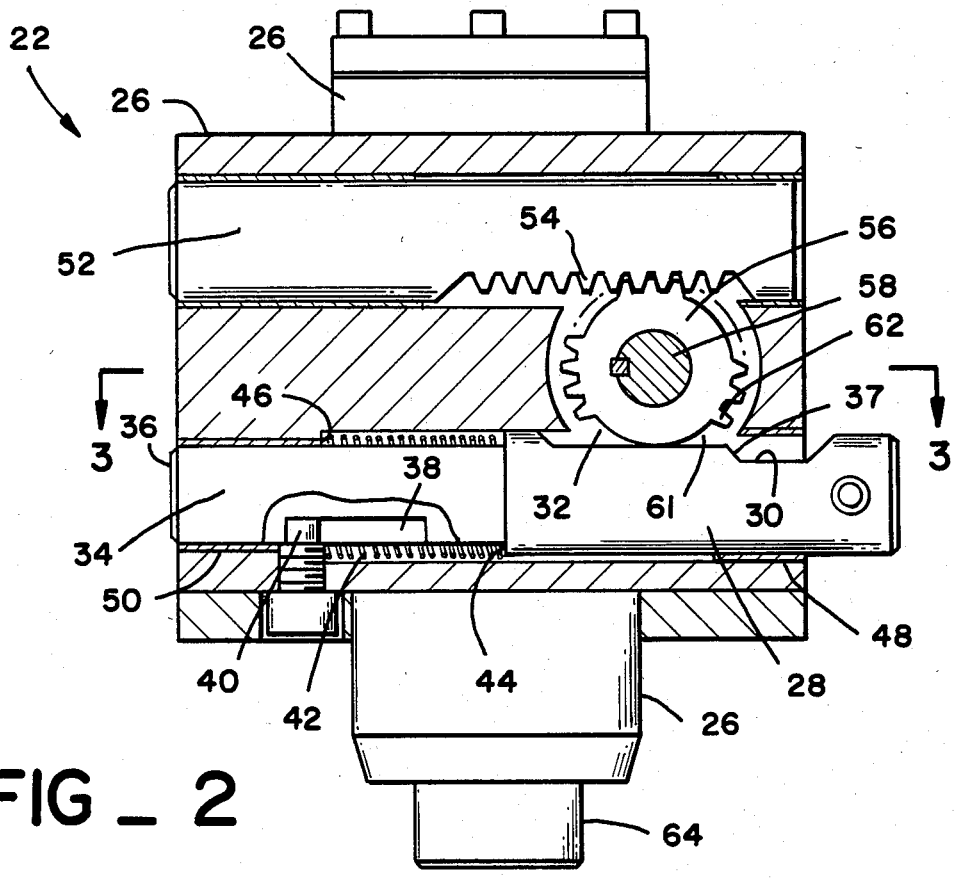
FIG. 2 is a vertical sectional view of the master stop assembly taken through the center of the assembly.
Figure 3:
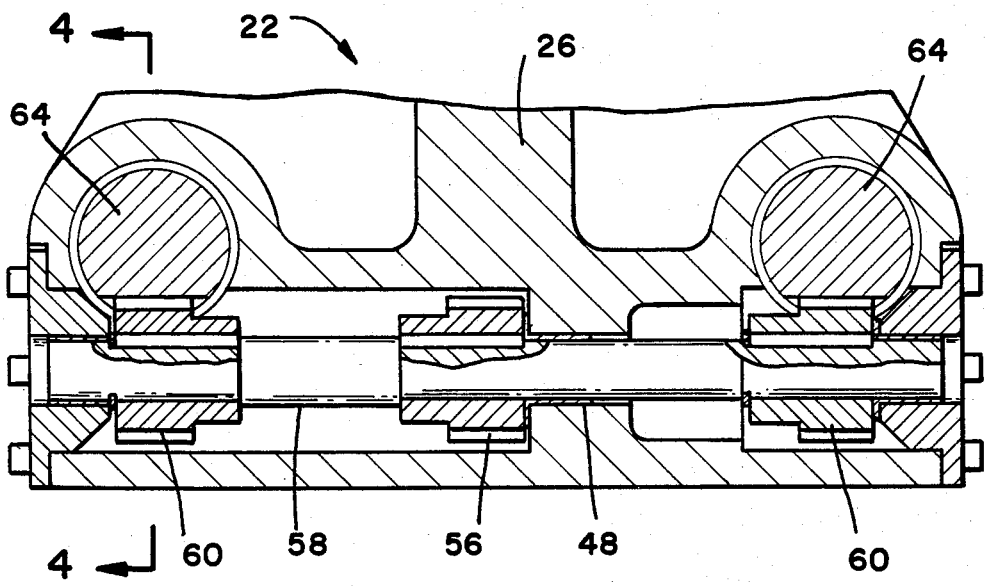
FIG. 3 is a horizontal sectional view of the master stop assembly taken along line 3—3 in FIG. 2.
Figure 4:
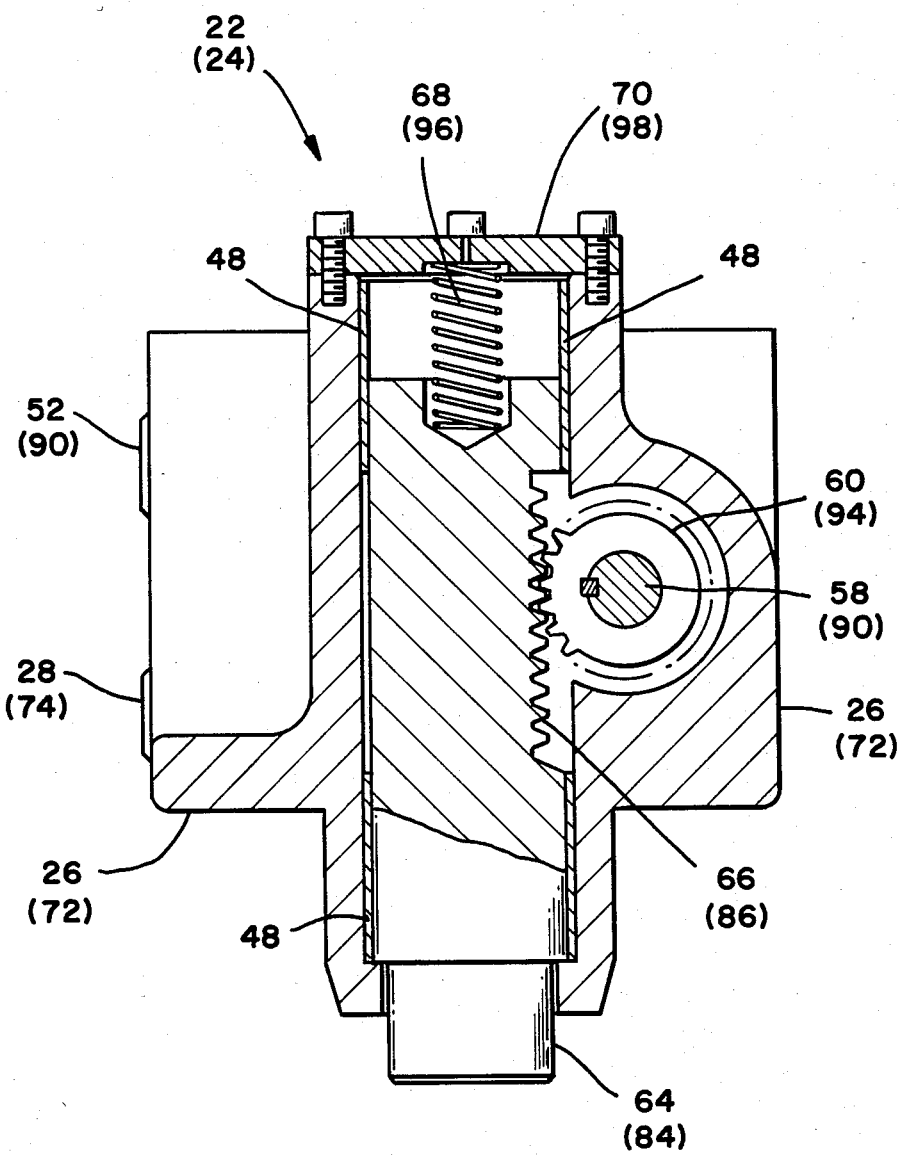
FIG. 4 is a vertical sectional view through a stop pin common to the master stop assembly and the slave stop assembly taken along line 4—4 in FIG. 3 and along line 4—4 in FIG. 6.

Referring now to FIGS. 2–4, a master stop assembly 22 includes a master stop housing 26 having a horizontal bore for receiving a master pin 28. The master pin 28 has a first recessed surface 30, a second recessed surface 32, and barrel section 34 having a beveled end 36. A locking surface 37 is formed between surface 30 and surface 32. The barrel section 34 has a rectangular channel 38 for receiving a travel stop 40. A helical spring 42 is disposed around the barrel section 34 between an annular shoulder 44 on the pin and a shoulder 46 on the housing 28 to maintain the end of channel against the travel stop 40 when the stop system is unactuated as shown in FIGS. 2–4. Bushings 48 (all bushings shown in the drawings are identified by the reference number 48) are also disposed around the master pin 28.

The housing 26 of the master stop assembly 22 has an upper bore for receiving a locking pin 52. The locking pin 52 has a recessed portion having a row of teeth 54. The teeth 54 engage the teeth of a center gear 56 which is disposed in a third horizontal bore located between the upper and lower bores and oriented perpendicular thereto. The center gear 56 is coupled by a shaft 58 to two pin drive gears 60. The center gear 56 has a smooth section 61 which allows passage of the recessed section 32 of the master pin 28 in the lower horizontal bore. The last gear tooth 62 on the right before the smooth section 61 functions as a locking tooth in conjunction with locking surface 37 as will be explained hereinafter.

The housing 26 also has two vertical bores for receiving master stop pins 64. As best illustrated in FIG. 4 which shows a master stop pin 64 in its extended position, the master stop pin 64 has a toothed area 66 which engages one of the drive gears 60. A helical spring 68 is disposed between the top of the master stop pin 64 and the housing cap 70. A pair of bushings 48 are disposed around the master stop pin 64.

Figure 5:
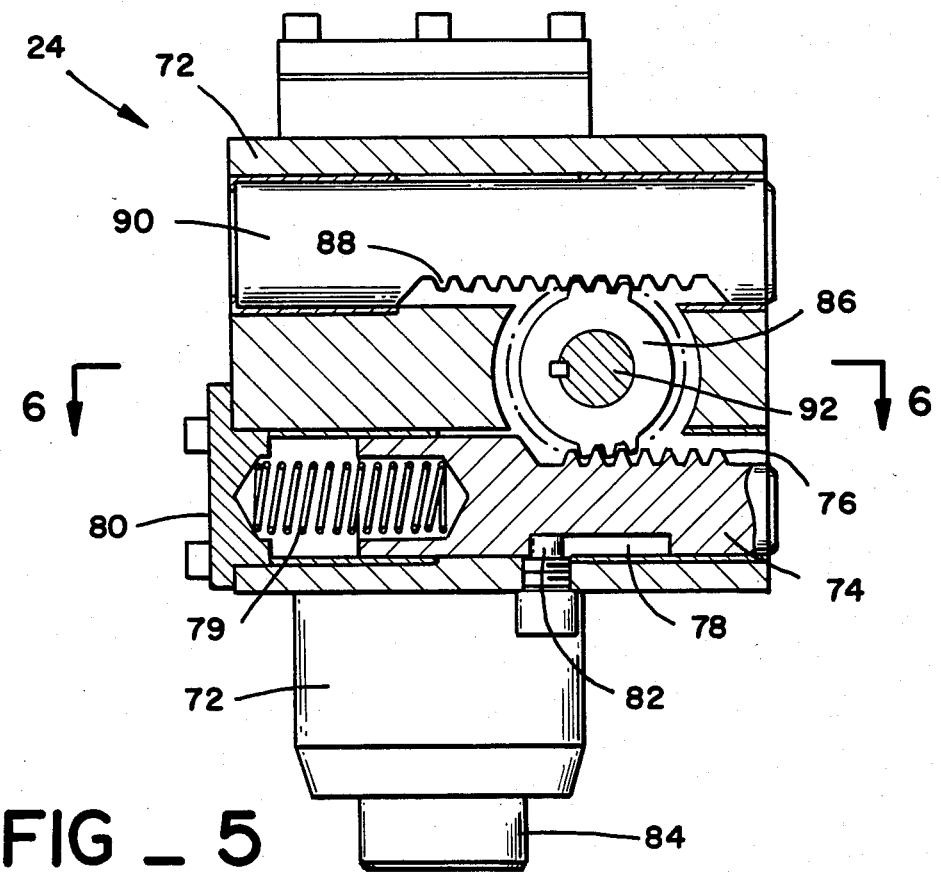
FIG. 5 is a vertical sectional view of the slave stop assembly taken through the center of the assembly.
Figure 6:
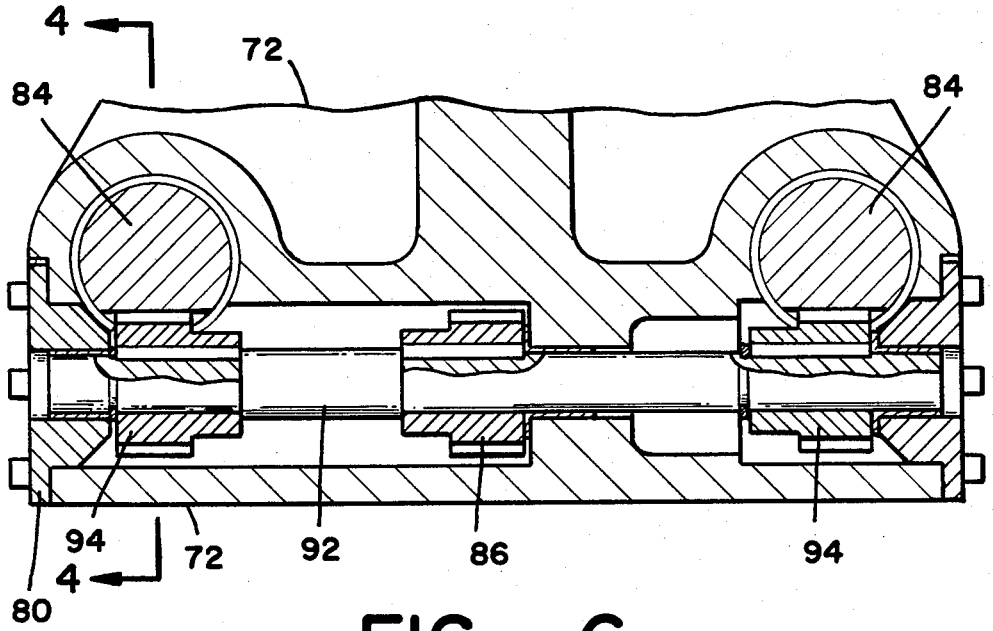
FIG. 6 is a horizontal sectional view of the slave stop assembly taken along line 6—6 in FIG. 5.

Referring now to FIGS. 5 and 6, the slave assembly 24 includes a housing 72 having an upper horizontal bore, a lower horizontal bore, and a central horizontal bore perpendicular to the upper and lower bores. The lower bore receives a slave pin 74 having a toothed section 76 and a rectangular channel 78. A helical spring 79 as disposed in the lower bore between the slave pin 74 and an end cap 80 for maintaining the end of the rectangular channel 78 against a travel stop 82 when the stop system is unactuated (i.e. the stop pins are extended) as shown in FIG. 5.

The toothed section 76 engages a center gear 86 disposed in the central horizontal bore. Gear 86 engages a toothed section 88 on a crossover pin 90 which is disposed in the upper bore. The center gear 86 is coupled by a shaft 92 to two pin drive gears 94 as shown in FIG. 6.

Referring now to FIG. 4 which is a view common to both the master stop assembly 22 and the slave stop assembly 24, the various elements of the slave stop assembly are identified by the reference characters in parentheses. The housing 72 has two vertical bores for receiving slave stop pins 84. The slave stop pin 84 has a toothed area 86 which engages one of the drive gears 94. A helical spring 96 is disposed between the top of the slave stop pin 84 and the housing cap 98. A pair of bushings 48 are disposed around the slave stop pin 84.

Figure 7:
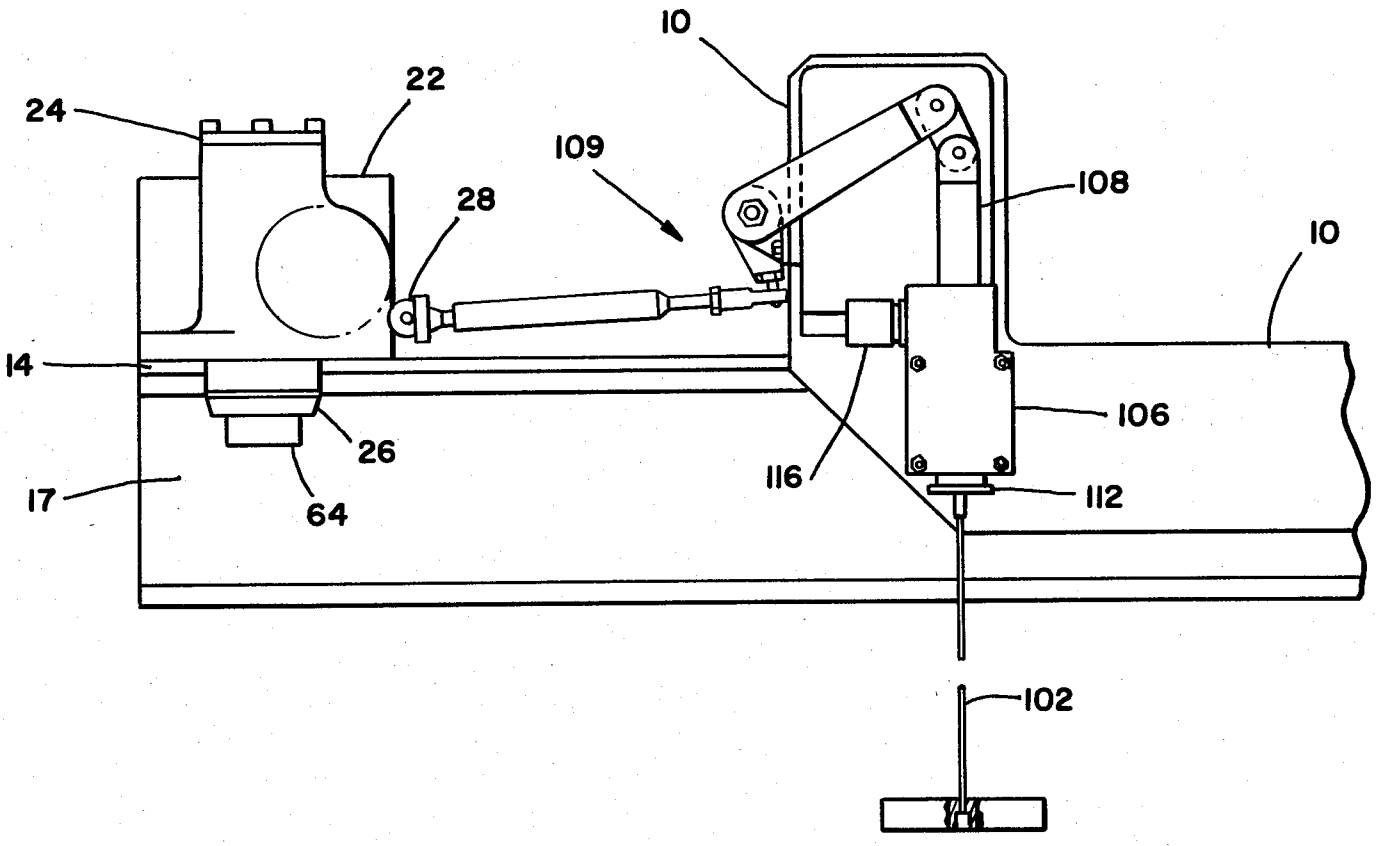
FIGS. 7 and 8 illustrate a preferred mechanism for actuating the stop system.
Figure 8:
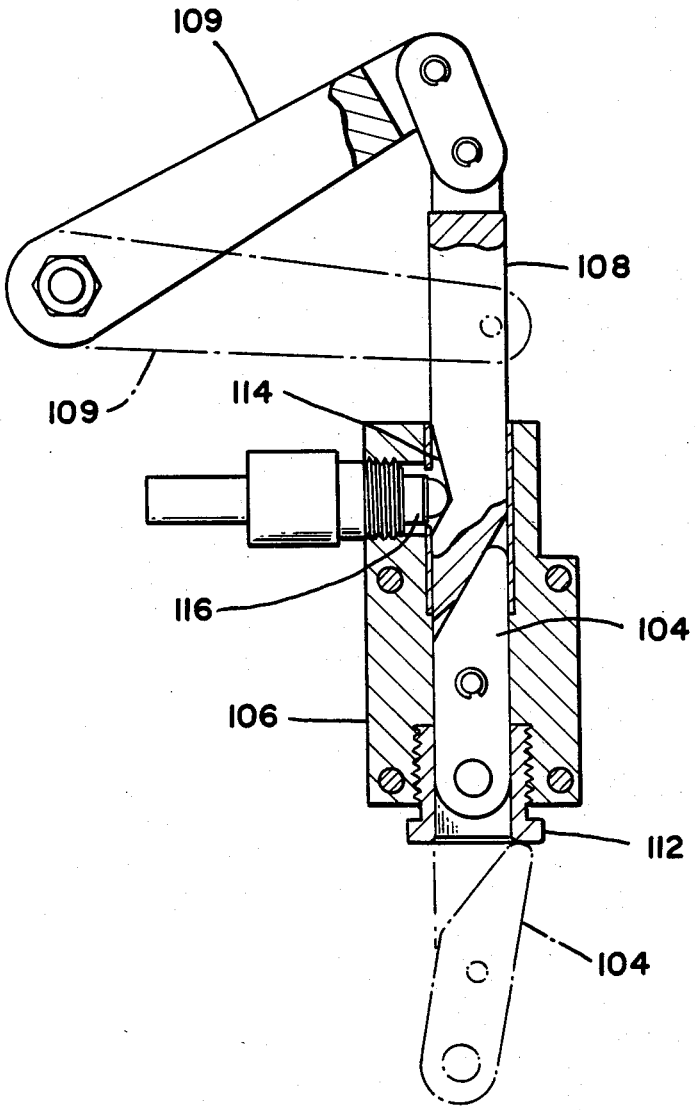

FIGS. 7 and 8 illustrate a preferred means for activating the hoist stop system. A master stop assembly 22 is shown mounted on a mounting plate 14 at the end of a bridge crane 10. A carrier rail 17 is attached below the plate 14. The lower part of the master stop housing 26 and the master stop pins 64 extend below the plate 14 with the stop pins 64 extending into the path of a hoist (not shown) on carrier rail 17 to prevent accidental traversing, beyond the master stop pins 64 and off of the end of the rail. Typically, the hoist will have a bumper plate which will strike the stop pins 64 or 84 when they are extended to prevent passage of the hoist and which will freely pass the stop pins when the stop pins are retracted to allow the hoist to traverse from a carrier rail to a crossover rail and visa versa.

The hoist stop system is actuated (actuation causes the stop pin 64 to retract into the housing 26 which allows passage of the hoist) by a manual actuation of a linkage shown in FIGS. 7 and 8. The actuated position is indicated by dashed lines while the unactuated position is indicated by solid lines in FIG. 8.

Actuation is initiated by manually pulling a lanyard 102 which pulls a locking link 104 out of a locking housing 106 which is attached to the crane frame 10. The locking link 104 is pivotably coupled to a locking shaft 108. The locking shaft 108 is coupled by various linkages 109 to the master pin 28 of the master stop assembly 22. When the locking link 104 is pulled out of the housing 106 and rotated to rest against adapter 112, the master pin 28 is pushed forward (to the left as shown in FIG. 2) to raise the stop pins on the master and slave assembly as will be described hereinafter.

The locking shaft 108 has a recessed area 114 which is adapted to control power (electric, pneumatic or hydraulic) to the crane 10. When the stop assembly is unactuated, the recessed area 114 allows a push activated switch 116 which controls the power to the crane to extend into the chamber of the locking housing 106. The initial portion of travel of the locking shaft 108 during actuation will move the recessed area 114 beyond the switch 116 to switch and thus remove power from the crane. The connecting linkages 109 are adapted so that additional travel is required before the master pin 28 is moved to ensure that the power to the crane 10 is disconnected before the stop pins 64 are retracted.

Turning now to the operating of the master stop assembly 22 and the slave stop assembly 24, to actuate the system the master stop assembly 22 and the slave stop assembly 24 are aligned. When the lanyard 102 is manually pulled as previously described to the locking position shown in FIG. 7, the master pin is pushed forward (from right to left in FIG. 2) via the linkage 109. If the carrying rail of the crane 10 is aligned with the crossover rail 16, the master pin 28 will push the slave pin 74 inward against spring 79. If the carrier rail 18 and the crossover rail 16 are not properly aligned, the master pin 28 will strike the slave housing 72 or miss the slave assembly altogether so that actuation is not completed.

If the master assembly 22 and the slave assembly 24 are properly aligned, the inward movement of slave pin 74 is coupled through center gear 86 to drive the crossover pin 90 a like distance to the right out of the housing 72. The movement of the crossover pin 90 in turn pushes the locking pin 52 of the master assembly 22 to the right. The movement of the locking pin in turn rotates the center gear 56 of the master assembly 22. Thus the center gears 56 and 86 of the master assembly and slave assembly, respectively, rotate simultaneously in a clockwise direction.

The rotation of center gear 56 is coupled by shaft 58 to gears 60. The rotation of center gear 86 is coupled by shaft 92 to gears 94. As best seen in FIG. 4, this clockwise rotation of gears 60 and 94, simultaneously retracts the stop pins 64 and 84 into the housing of the respective assemblies and out of the path of the hoist.

As the master pin 28 is pushed into the actuated position, the center gear 56 is rotated so that the locking tooth 62 is disposed in the recessed area 30 next to the locking surface 37. If the operator accidentally attempts to release the apparatus by releasing the locking link 104 before hoist has been completely transferred between the crossover rail and the carrier rail, the master stop assembly 22 and the slave stop assembly 24 will remain actuated. The master pin 28 will be maintained in the actuated position by the locking tooth 62 of center gear 56 against the locking surface 37. Center gear 56 is rigidly coupled to the stop pins 64 of shaft 58 and pin drive gears 60 so that master pin 28 cannot be withdrawn unless the stop pins 64 of the master assembly 22 and the stop pins 84 of the slave assembly 24 can be lowered. The body of the hoist itself will prevent the lowering of the stop pins if it is located under the stop assemblies. Thus, if an improper release is attempted, the stop pins 64 and 84 will move only a short distance to the body of the hoist so that the center gear 56 can rotate only a very slight amount. This maintains the master pin 28 in the actuated position. Because the master pin is locked in the actuated position, the switch 116 is also maintained closed by locking shaft 108, so that power is removed from the crane until the hoist has completed the transfer.

Obviously, many modifications and variations of the present invention are possible in light of the above teachings. It is therefore to be understood that within the scope of the appended claims, the invention may be practiced otherwise than as described.

What is claimed is:

1. A rail interlocking and hoist stop apparatus for material handling systems in which a hoist travels between a movable rail and a stationary rail, which comprises:

(a) a master stop assembly mounted at the end of the movable rail;

(b) a slave stop assembly mounted at the end of the stationary rail; said master stop assembly including (1) a master housing;

(2) a master pin slidably disposed in said master housing for movement parallel to the longitudinal direction of said rails, said master pin being moved toward said stationary rail to actuate said apparatus to interlock the rails and allow the hoist to travel between the stationary rail and the movable rail;

(3) a locking pin slidably disposed in said master housing for sliding parallel to the longitudinal direction of said rails, said locking pin being moved away from said stationary rail when said apparatus is actuated;

(4) a master stop pin movably disposed in said master housing for movement into the path of said hoist to prevent travel of said hoist between the movable rail and said stationary rail and for movement out of the path of said hoist to allow travel of said hoist between the movable rail and the stationary rail, (5) means for coupling the movement of said locking pin to said master stop pin, movement of said locking pin away from said stationary rail moving said master stop pin allowing travel of said hoist between the movable rail and the stationary rail, said slave stop assembly including:

(1) a slave housing;

(2) a slave pin slidably disposed in said slave housing for movement parallel to the longitudinal direction of said rails, said slave pin being aligned with said master pin when the movable rail and the stationary rail are aligned, said slave pin being pushed by said master pin when said apparatus is actuated;

(3) a crossover pin slidably disposed in said slave housing for sliding parallel to the longitudinal direction of said rails, said crossover pin aligned with said locking pin when the movable rail and the stationary rail are aligned, said crossover pin pushing said locking pin when said apparatus is actuated;

(4) means for coupling said slave pin and said crossover pin so that movement of either one of said pins is one direction will cause the other one of said pins to move in the opposite direction;

(5) a slave stop pin movably disposed in said housing for movement into the path of said hoist to prevent travel of said hoist between the movable rail and said stationary rail and for movement out of the path of said hoist to allow travel of said hoist between the movable rail and the stationary rail;

(6) means for coupling the movement of said slave pin and said crossover pin to said slave stop pin, the movement of said crossover pin toward said movable rail moving said slave stop pin to allow travel of the hoist between the stationary rail and the movable rail; and (c) means for sliding said master pin toward said stationary rail to actuate said apparatus.

2. Apparatus as recited in claim 1 wherein said means for coupling the movement of said locking pin to said master stop pin comprises first gear means coupled between gear teeth on said locking pin and gear teeth on said master stop pin.

3. Apparatus as recited in claim 2 wherein said means for coupling said slave pin to said crossover pin comprises second gear means coupled between gear teeth on said slave pin and gear teeth on said crossover pin and wherein said means for coupling the movement of said slave pin and said crossover pin to said slave stop pin comprises third gear means coupled between gear teeth on said slave stop pin and said second gear means.

4. Apparatus as recited in claim 3 wherein said means for sliding said master pin toward said stationary rail further comprises means for disabling movement of the movable rail before said slave stop pin and said master stop pin are moved out of the path of said hoist.

5. Apparatus as recited in claim 3 wherein said master housing comprises:

a master housing body having a first horizontal bore parallel to the direction of the movable track, a second horizontal bore parallel to the direction of said movable track, and a central horizontal bore perpendicular to said first and second bores, and a vertical bore, said master pin being disposed in said first horizontal bore, said locking pin being disposed in said second horizontal bore, said master stop pin being disposed in said vertical bore, and said first gear means being disposed in said central horizontal bore; and wherein said slave housing comprises:

a slave housing body having a first horizontal bore parallel to the direction of the stationary track, a second horizontal bore parallel to the direction of the stationary track, a central horizontal bore perpendicular to said first and second horizontal bores, and a vertical bore, said slave pin being disposed in said first horizontal bore, said crossover pin being disposed in said second horizontal bore, said slave stop pin being disposed in said vertical bore, and said second gear means being disposed in said central horizontal bore.

* * * * *